US012084099B2

(12) United States Patent
Mueller et al.

(10) Patent No.: US 12,084,099 B2
(45) Date of Patent: Sep. 10, 2024

(54) METHOD AND ARRANGEMENT FOR IDENTIFYING A RAIL VEHICLE WHEEL

(71) Applicant: Schenck Process Europe GmbH, Darmstadt (DE)

(72) Inventors: Ralph Mueller, Darmstadt (DE); Viktor Rais, Muehltal (DE)

(73) Assignee: Schenck Process Europe GmbH, Darmstadt (DE)

( * ) Notice: Subject to any disclaimer, the term of this patent is extended or adjusted under 35 U.S.C. 154(b) by 895 days.

(21) Appl. No.: 17/154,681

(22) Filed: Jan. 21, 2021

(65) Prior Publication Data

US 2021/0139060 A1 May 13, 2021

Related U.S. Application Data

(63) Continuation of application No. PCT/EP2019/066926, filed on Jun. 26, 2019.

(30) Foreign Application Priority Data

Jul. 20, 2018 (DE) ..... 10 2018 117 579.5

(51) Int. Cl.
*B61L 25/04* (2006.01)
*B61K 9/12* (2006.01)

(52) U.S. Cl.
CPC ..... *B61L 25/04* (2013.01); *B61K 9/12* (2013.01)

(58) Field of Classification Search
CPC .. B61L 1/14; B61L 1/163; B61L 1/169; B61L 1/20; B61L 25/04; B61K 9/00; B61K 9/12
See application file for complete search history.

(56) References Cited

FOREIGN PATENT DOCUMENTS

EP 1207091 A1 * 5/2002 ..... B61K 9/12
WO WO 00/73118 A1 12/2000

OTHER PUBLICATIONS

Matthias Wolf, "Use of "Wayside Acoustic Monitoring" by DB AG," Signaling Datacommunication, vol. 110, pp. 27-32 (Apr. 2018) with English translation included.
Schenck Process, "MULTIRAIL® Wheelscan modular wayside train monitoring system," Brochure, pp. 1-5 (Aug. 20, 2018).

* cited by examiner

*Primary Examiner* — Robert J McCarry, Jr.
(74) *Attorney, Agent, or Firm* — Muncy, Geissler, Olds & Lowe, P.C.

(57) ABSTRACT

A method for recognizing a rail vehicle wheel as well as an arrangement for recognizing a rail vehicle wheel. A specific detection pattern of the rail vehicle wheel to be identified is ascertained using rollover signal of a rail vehicle wheel to be identified, which is ascertained with the aid of a load measuring device arranged on a rail, the rollover signal describing a time characteristic of a rail load induced by the rail vehicle wheel to be identified on the rail equipped with the load measuring device during the rollover, and the specific detection pattern comprising one or multiple identification parameter(s)/characteristic value(s) ascertained using the rollover signal. The ascertained specific detection pattern of the rail vehicle wheel to be identified is compared with one or multiple predefined reference-specific detection pattern(s) of rail vehicle wheels, and the rail vehicle wheel to be identified is identified by the comparison.

17 Claims, 2 Drawing Sheets

METHOD AND ARRANGEMENT FOR IDENTIFYING A RAIL VEHICLE WHEEL

This nonprovisional application is a continuation of International Application No. PCT/EP2019/066926, which was filed on Jun. 26, 2019 and which claims priority to German Patent Application No. DE 10 2018 117 579.5, which was filed in Germany on Jul. 20, 2018 and which are both herein incorporated by reference.

BACKGROUND OF THE INVENTION

Field of the Invention

The present invention relates to a method for recognizing a rail vehicle wheel as well as an arrangement for recognizing a rail vehicle wheel.

Description of the Background Art

To ensure or to increase a safety in rail traffic, in which rail vehicles travel in a rail network, the rail traffic or the rail vehicles traveling on tracks or on rails of the rail network are monitored with the aid of corresponding monitoring systems.

In the case of monitoring systems of this type, stationary monitoring systems, i.e. arranged on the rails, are known, which ascertain the loads acting upon the rails, in particular if rail vehicles are in traveling mode on the rails of the rail network or are traveling on them.

For example, the document "MULTIRAIL WheelScan," Schenck Process GmbH, BV-D2144DE, 2013, describes a stationary monitoring system of this type with the "MULTIRAIL Wheelscan" system.

"MULTIRAIL Wheelscan" provides a concrete measuring tie integrated into a rail and equipped with measuring sensors or load cells, whose measuring sensors measure the loads, i.e. vertical forces in this case, as a result of weight and track guidance forces on the rail, in a highly precise manner and to evaluate them for a wheel diagnosis (detecting wheel imperfections such as flat spots, roughnesses, out-of-roundnesses), rail car detection, distributed load control or also load regulation and the like.

In a wheel diagnosis of this type using "MULTIRAIL Wheelscan," for example, positions and sizes of imperfections, such as out-of-roundnesses, are ascertained for the rail vehicle from the loads on a wheel-by-wheel or railcar-by-railcar basis, measured when a rail vehicle passes over "MULTIRAIL Wheelscan."

However, to then be able to assign the load measurements and evaluations of such monitoring systems or load measuring devices, such as "MULTIRAIL WheelScan," to the particular rail vehicle traveling over the monitoring system or load measuring device (during the load measurement), to thereby make it possible to ensure a longer lasting trend tracking or a condition monitoring of a rail vehicle, a recognition and identification of the rail vehicle is necessary.

This may take place with the aid of numeric identifiers or wireless labels (RFID) on the rail vehicle, which are read in by the monitoring system/load measuring device in parallel to the load measurement with the aid of corresponding reading systems and then assigned to the load measurement of the monitoring system/load measuring device.

However, this requires the monitoring system or the load measuring device and the reading/identification system to be directly coordinated and to directly communicate with each other, or the two systems must make their results available to a central point, at which the assignment may then take place, for example a central train route database.

Both of these—either directly coordinated and communicating systems or a central point (indirectly) coordinating the systems—are complex and/or require additional equipment/outfitting, which, in turn, results in higher costs and error susceptibility.

SUMMARY OF THE INVENTION

It is therefore an object of the invention to improve disadvantages of the prior art. In particular, an object of the invention is to make the monitoring of rail traffic/trail vehicles easy, more cost-effective and safer. Specifically, the object of the invention is also to efficiently recognize or identify rail vehicles during/upon their monitoring in an easy, cost-effective and safe or reliable manner.

In an exemplary embodiment, this object is achieved by a method for recognizing a rail vehicle wheel as well as an arrangement for recognizing a rail vehicle wheel, having the features of the particular independent claim.

The arrangement for recognizing a rail vehicle wheel provides an ascertainment device, which is configured to carry out the method for recognizing a rail vehicle wheel.

In the method for recognizing a rail vehicle wheel, it is provided that a specific detection pattern of this rail vehicle wheel is ascertained, using a rollover signal of an arbitrary rail vehicle wheel, which is ascertained with the aid of a load-measuring device arranged on a rail, for example "MULTIRAIL WheelScan," hereinafter also referred to as "monitoring system"

This rollover signal describes a time characteristic of a rail load induced by the rail vehicle wheel on the rail equipped with the load-measuring device during the rollover.

A rollover signal of this type may be, for example, a force, moment and/or acceleration signal from a load-measuring device or from a monitoring system, for example "MULTIRAIL WheelScan."

The rollover signal is advantageously ascertained with the aid of the load-measuring device, in particular with the aid of a measuring section, which comprises a measuring rail or a measuring tie, when the rail vehicle wheel to be identified rolls over the rail equipped with the load-measuring device, for example with the aid of "MULTIRAIL WheelScan."

In other words, or on the arrangement side, the arrangement may advantageously provide a load-measuring device, in particular a measuring section having a measuring rail or a measuring tie, which is configured to ascertain the rollover signal, for example "MULTIRAIL WheelScan."

The specific detection pattern comprises one or multiple time-independent identification parameters/characteristic values ascertained using the rollover signal.

In simple and succinct terms, the one or multiple time-independent identification parameters/characteristic values, which represent or are combined into the specific detection pattern of the rail vehicle wheel to be identified, are formed from the rollover signal.

An identification parameter/characteristic value of this type may be, for example, a wheel circumference, an imperfection, in particular a flat spot, a roughness or an out-of-roundness, in particular a periodic out-of-roundness, and/or a load pattern as a function of a wheel angle or a wheel circumference, in particular a phase-adjusted and/or standardized load pattern, and/or a frequency spectrum, a wavelength spectrum or their amplitude ratios of a load pattern.

If the specific detection pattern comprises multiple time-independent identification parameters/characteristic values, each ascertained using the rollover signal, they may remain in the specific detection pattern as individual parameters/characteristic values. Alternatively, they may be compiled/combined into an overall parameter/characteristic value, which then forms the specific detection pattern.

In the method for recognizing a rail vehicle wheel, the ascertained specific detection pattern of the rail vehicle wheel to be identified is then furthermore compared with one or multiple previously stored or predefined reference-specific detection pattern(s) of rail vehicle wheels.

It is advantageous if the one or multiple predefined reference specific detection patterns is or are of the same type as the ascertained specific detection pattern with respect to the parameters or characteristic values ("comparison of apples with apples, not apples with pears").

The predefined reference specific detection pattern(s) may also be stored or become stored in a database.

In the method and arrangement for recognizing a rail vehicle wheel, it is also advantageous if the reference specific detection pattern(s) is/are updated, in particular with the ascertained specific detection pattern of the rail vehicle wheel to be identified. This means that the stored reference specific detection pattern is compared with its current specific detection pattern after recognizing a rail vehicle wheel and updated with respect to the parameters or characteristic values in the case of possible time-dependent deviations.

In other words or on the arrangement side, the arrangement may advantageously provide a database, in which the reference specific detection patterns are stored and/or updated.

Due to the comparison of ascertained specific detection patterns of the rail vehicle wheel to be identified with one or multiple predefined reference-specific detection pattern(s) of rail vehicle wheels, the rail vehicle wheel is then located in the method for recognizing a rail vehicle wheel.

During the comparison, a deviation/tolerance may be permitted or taken into account to thereby ensure the recognition, despite random inaccuracies/deviations.

The method and the arrangement for recognizing a rail vehicle wheel are based on the finding that rail vehicle wheels never or rarely demonstrate exactly the same signs of abrasion, and a specific rail vehicle wheel generally only slowly changes its properties over the course of its useful life. In other words, each rail vehicle wheel possesses/involves wheel-specific or wheel-immanent properties, which remain almost unchanged over its useful life.

Observations have shown that the rollover signal of one and the same rail vehicle wheel repeats astonishingly well over the course of its useful life. A rollover signal measured multiple times over the useful life of a rail vehicle wheel may thus change in terms of its absolute amplitude heights, the height of adjacent amplitudes, however, having reproducible ratios. In clear and simple terms, imperfections of a rail vehicle wheel remain where they are and change only in terms of their prominence.

In short, the rollover signal of a rail vehicle wheel is or will remain specific to this rail vehicle wheel.

The method and the arrangement for recognizing a rail vehicle wheel now use this finding/observation in that they generate, from the rollover signal of a rail vehicle wheel, a specific detection pattern of the rail vehicle wheel to be identified or one or multiple time-independent identification parameters/characteristic values—effectively a fingerprint—for the rail vehicle wheel.

However, the method and the arrangement for recognizing a rail vehicle wheel take into account the situation that the rollover signal—as a time signal measured during the rollover of the rail vehicle wheel over a load-measuring device or a monitoring device (on a rail)—is dependent on the (particular) rollover speed of the rail vehicle or rail vehicle wheel over the load-measuring device/monitoring system (on the rail), which complicates or makes difficult the ability to directly compare rollover signals.

The method and the arrangement for recognizing a rail vehicle wheel thus form time-independent parameters/characteristic values from the rollover signal, i.e the one or multiple time-independent identification parameter(s)/characteristic value(s), which then form(s) the rail vehicle wheel-specific fingerprint.

This fingerprint of a particular rail vehicle wheel then permits the (unique) identification of this rail vehicle wheel. Moreover, the rail vehicle may also be identified and detected via its recognized rail vehicle wheels. As described above, the fingerprint of a rail vehicle wheel is individual and remains specific over the useful life of the rail vehicle wheel.

Due to the method and the arrangement for recognizing a rail vehicle wheel, an additional reading/identification system in the rail vehicle may be dispensed with when monitoring the rail traffic or vehicle, the aforementioned, for example, based on numeric identifiers and/or RFID, which (additional reading/identification system must be able to communicate directly or indirectly with the monitoring system or the load measuring device.

In the method and arrangement for recognizing a rail vehicle wheel, in simplified and clear terms, the rail vehicle wheel, and thereby the rail vehicle, is identified via its recognized rail vehicle wheels, solely "on its own," based on "its" data supplied by the monitoring data or the load measuring device. Additional data to be ascertained by other or additional systems (and the systems) is not necessary (anymore) for the identification or rail traffic/rail vehicle monitoring with the method and arrangement for recognizing a rail vehicle wheel. It is also advantageous if the specific detection pattern additionally comprises at least one further time-independent identification parameter/characteristic value ascertained using a further measuring signal, because the identification security during the location and recognition of the rail vehicle wheel may be further increased thereby.

This at least one further identification parameter/characteristic value may advantageously be a rate of wear from a transverse profile of a rail vehicle wheel, in particular a wheel flange thickness, a wheel flange height and/or a flank angle. Corresponding measuring devices, possibly including mobile ones, such as railway repair shop production means of Deutsche Bundesbahn Systemtechnik (the engineering center of German Federal Railways), may be provided—on the arrangement side—for example, for measuring a wheel flange thickness, a wheel flange height or wheel tire/wheel flange thicknesses.

The method and arrangement for recognizing a rail vehicle wheel may preferably also be used for a trend tracking of a physical variable in the rail vehicle wheel to be identified, for example a wheel profile, a (position and/or size of an) imperfection and/or a flat spot/out-of-roundness in the rail vehicle wheel, the specific detection pattern of the rail vehicle wheel to be identified (then) being ascertained and compared multiple times.

In addition, if the rail vehicle wheel may be identified as the same/identical rail vehicle wheel in each case, load measurements assignable to this rail vehicle wheel or analyses relating thereto, which explain the aforementioned physical variables, such as wheel profile sizes, positions/sizes of imperfections and/or flat spots/out-of-roundnesses, supply the trend tracking.

For example, the trend in a damage development or the damage development on a rail vehicle wheel, for example the characteristic development of an imperfection on the rail vehicle wheel, may be observed, and a relevant condition monitoring may be carried out without the rail vehicle having to seek out a repair shop in a time-consuming and costly manner. In addition, the identification of the rail vehicle, would have to first take place, also with the aid of reading/identification systems situated there, for example based on the numeric identifiers and/or RFID.

The method and arrangement for recognizing a rail vehicle wheel may be particularly preferably used to ascertain a wheel damage, after multiple recognition and comparison or multiple identification, the trend and/or the development of a wheel damage on the rail vehicle wheel identified or to be identified is/are observed, and/or the wheel damage on the rail vehicle wheel identified or to be identified is classified and/or detected as wheel damage, if the degree of damage exceeds a predefinable limit value.

In the case of a trend tracking/condition monitoring of this type or multiple comparison and identification, it may be advantageous, in particular, to update the corresponding reference-specific detection pattern, which "results' in the identification during the (current) comparison, with the (currently) ascertained specific detection pattern in each case.

The method and arrangement for recognizing a rail vehicle wheel may preferably be used to recognize an axle of the rail vehicle, a bogie of the rail vehicle and/or the rail vehicle, the specific detection pattern of multiple rail vehicle wheels to be identified, in particular that of an axle of the rail vehicle, a bogie of the rail vehicle and/or the rail vehicle, may then be combined.

For the "identification comparison" using the one or multiple reference-specific detection patterns, corresponding combinations of the one or multiple reference-specific detection patterns may also be formed.

In other words, the specific detection patterns of the two rail vehicle wheels opposite each other on the axle may be combined for the specific detection pattern or the fingerprint of a rail vehicle axle.

Correspondingly, for the specific detection pattern or the fingerprint of a rail vehicle bogie, the specific detection patterns of the rail vehicle wheels situated on this rail vehicle bogie may be combined for a rail vehicle bogie.

Correspondingly, for the specific detection pattern or the fingerprint of a rail vehicle, the specific detection patterns of the rail vehicle wheels or the bogie situated on this rail vehicle may be combined for a rail vehicle.

The ascertained, combined specific detection patterns or fingerprints may then be compared with corresponding combinations of reference-specific detection patterns.

Deviations/tolerances may also be taken into account for the particular comparisons for identification purposes. It may thus be particularly advantageous to set higher tolerances for detecting a rail vehicle or a rail vehicle bogie or a rail vehicle axis than for individual rail vehicle wheels.

It may also be advantageous to take into account a position of the rail vehicle wheel to be identified on the rail vehicle axle or on the rail vehicle bogie or in the rail vehicle when combining the specific detection patterns or fingerprints of the rail vehicle wheels into rail vehicle axles/rail vehicle bogies/rail vehicles, for example "front"/"rear," or "left"/"right" or "left front"/"right front"/"left rear"/"right rear."

The description of advantageous embodiments of the invention described up to now contains numerous features which are provided in the individual subclaims, in part combined into multiple features. However, these features may also be advantageously examined individually and combined into other sensible combinations. In particular, these features are each able to be combined individually and in any suitable combination with the method according to the invention and the arrangement according to the invention.

Even if individual terms in the description or in the patent claims are each used in the singular or in combination with a numeral, the scope of the invention is not to be limited to the singular or the particular numeral for these terms. Moreover, the words "ein" or "eine" are not to be understood as numerals but as indefinite articles.

The properties, features and advantages of the invention, as well as the way in which they are achieved, become clearer and much more understandable in connection with the following description of the exemplary embodiments of the invention, which are explained in greater detail in connection with the drawing(s)/figure(s) (the same parts/components and functions have the same reference numerals in the drawings/figures). The exemplary embodiments are used to explain the invention and do not limit the invention to the combination of features indicated therein, not even with reference to functional features. In addition, suitable features of each exemplary embodiment may also be explicitly viewed in isolation, removed from an exemplary embodiment, incorporated into another exemplary embodiment to supplement the latter, and combined with any of the claims.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
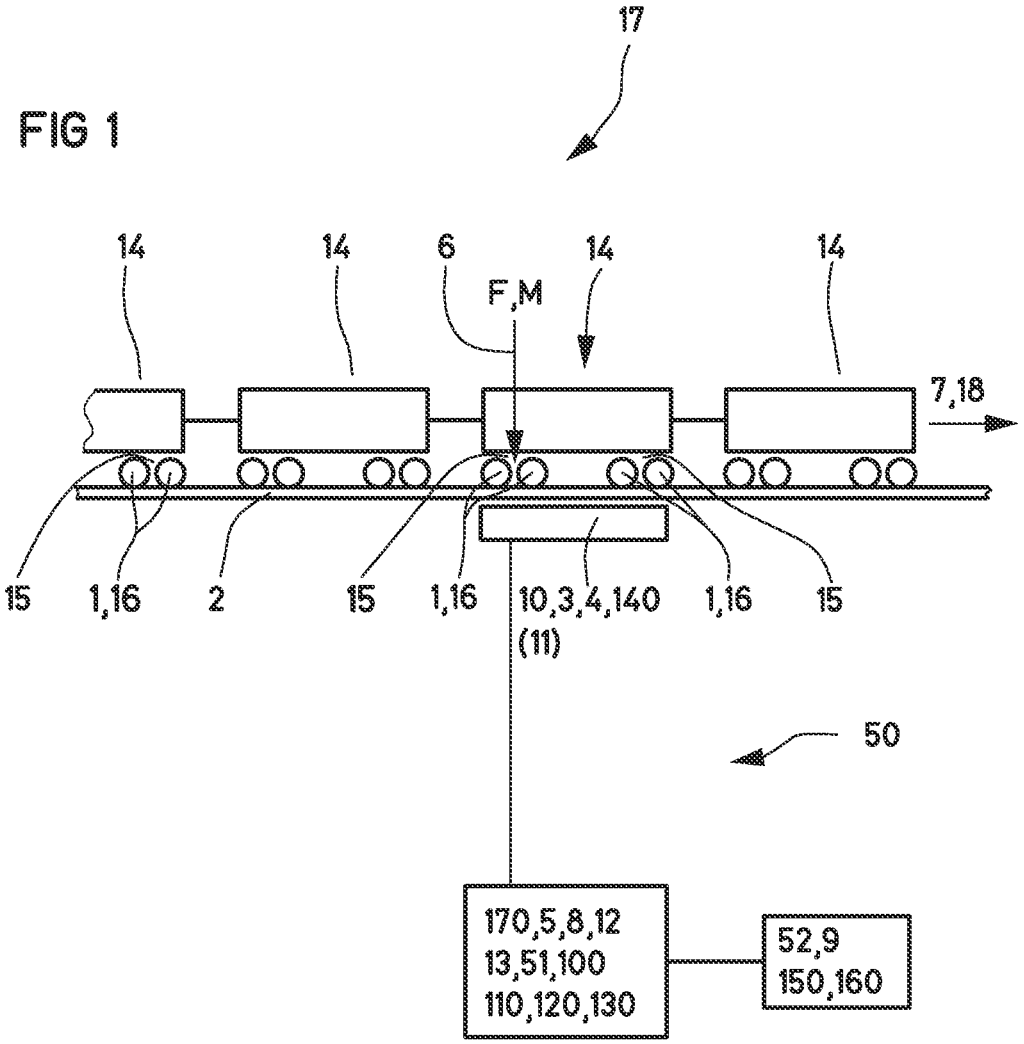
FIG. 1 schematically shows the monitoring of a rail traffic or a rail vehicle with the aid of a digital fingerprint formed for the rail vehicle.

FIG. 1 shows a part of a rail vehicle combination 17, made up of multiple rail vehicles 14 (such as cargo and/or passenger cars) (referred to in short only as train 17), which is in traveling mode 18 (as illustrated in FIG. 1), in which it travels in a rail network (made up of tracks having rails 2 arranged side by side) and passes over a rail 2 (from the rail network) multiple times (as also illustrated in FIG. 1).

Each rail vehicle 14 has a front and rear two-axle bogie 15, each of whose axles 16 carries a left and a right rail vehicle wheel 1.

Rail 2, over which train 17 or rail vehicles 14 pass, is equipped with a stationary monitoring system 3, as shown in FIG. 1, the "MULTIRAIL WheelScan" in this case, which ascertains rail loads 6 acting upon rail 2 by train 17/rail vehicle 14 or by its rail vehicle wheels 1 (when traveling over them, i.e. in traveling mode 18 or during rollover 7).

Monitoring system 3 "MULTIRAIL WheelScan" represents a measuring section 10 integrated into a rail, i.e. in rail 2 in this case, which includes or is formed by a concrete measuring tie 3 (weighing tie) equipped with measuring sensors or load cells, whose measuring sensors, in particular force sensors (and/or moment sensors), measure rail loads 6, i.e. (vertical) forces F (and moments M) as a result of track guidance forces and weight forces on rail 2.

Figure 2:
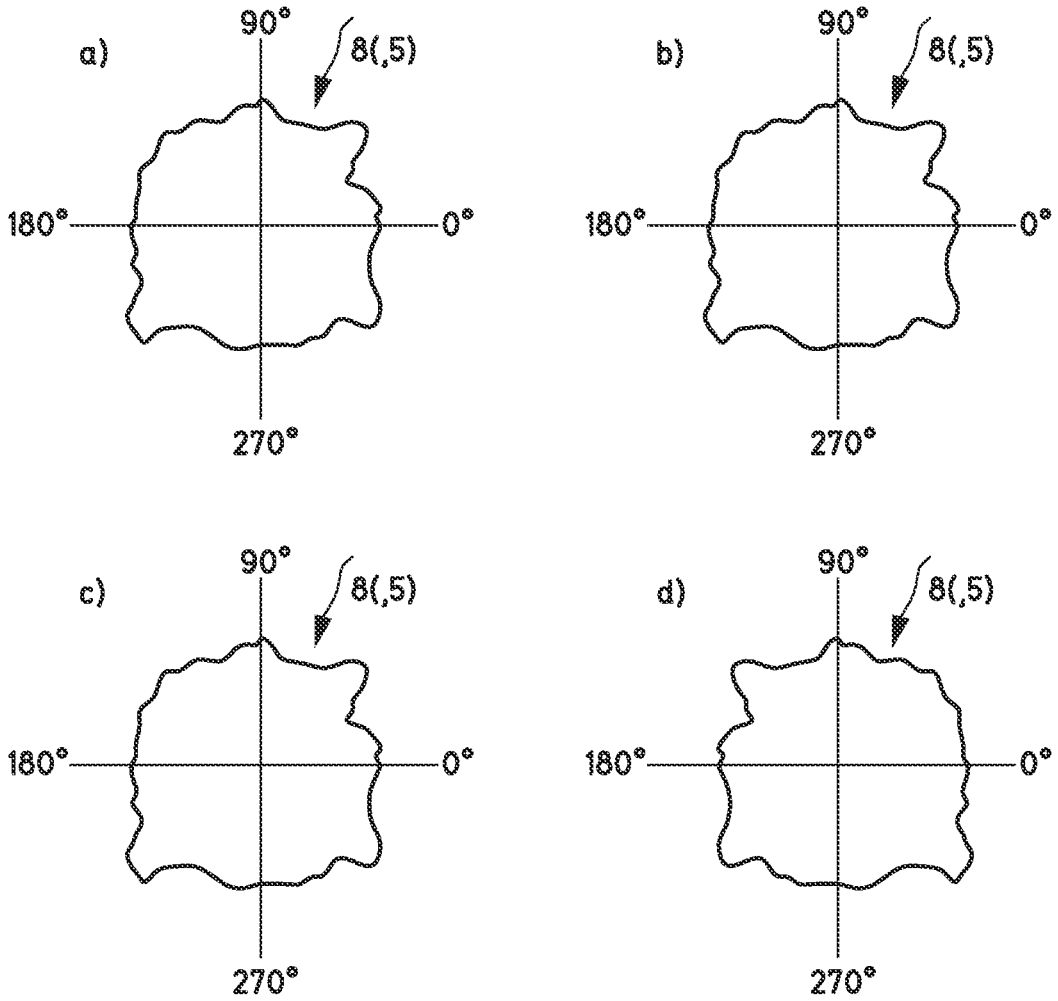
FIG. 2 shows a rollover signal generated by a rail vehicle wheel at different points in time when rolling over a load measuring device arranged on a rail over the circumference of the rail vehicle wheel.

In other words, stationary monitoring system 3, or "MULTIRAIL WheelScan," measures 140 a time- or speed-dependent rollover signal 4 of this type (for example vertical contact force F in this case) for a rail vehicle wheel 1 of a rail vehicle 14 of train 17 rolling thereover 7 (cf. FIG. 2).

As is also shown in FIG. 1, stationary monitoring system 3, or "MULTIRAIL WheelScan," is connected to a computing system/computer 51 (ascertainment system 51), which, in turn, has a database 52 (both together hereinafter referred to as "MULTIRAIL WheelScan" or monitoring system 3).

As is also clarified in FIG. 1, loads 6 measured in this case by "MULTIRAIL WheelScan" for train 17, i.e. rollover signals 4 of rail vehicle wheels 1, are transmitted to computing system/computer 51 (ascertainment system 51), where an evaluation, for example a wheel diagnosis (detection of wheel imperfections, such as flat spots, roughnesses or out-of-roundnesses), a rail car detection, a distributed load control and a load regulation thereof take place.

To this is now added a trend tracking or a condition monitoring 170 on/of rail vehicles 14 (within the scope of the monitoring of the rail traffic or a rail vehicle 14) to be able to monitor/establish or track a damage development on rail vehicle 14, specifically in this case on a rail vehicle wheel 1 of a rail vehicle 14. By tracking the trend of the specific detection pattern or the digital fingerprint or the associated characteristic values and parameters, a wheel damage may be detected during the course of preventive maintenance, and a wheel failure may be avoided.

For this trend tracking or this condition monitoring 170 on/of rail vehicles 14 or for monitoring/establishing/tracking a damage development on a rail vehicle wheel 1 of a rail vehicle 14 by "MULTIRAIL WheelScan," it is necessary to be able to assign rollover signals 4 (measured multiple times at different points in time on measuring section 10 or using "MULTIRAIL WheelScan") (and thereby also then the associated evaluations carried out by "MULTIRAIL WheelScan," such as the wheel diagnosis (detection of wheel imperfections, such as flat spots, roughnesses and out of-roundnesses)) to a certain rail vehicle wheel 1 of a certain rail vehicle 14.

In other words, an identification of a rail vehicle wheel 1 is necessary or a prerequisite for damage trend tracking/damage condition monitoring 170.

This identification 100 takes place, as illustrated in FIG. 1, in a "system-immanent" manner, "i.e. from "existing means", i.e. based on rollover signals 4 of rail vehicle wheel 1, without requiring additional systems (for example numeric identifiers/RFID, using corresponding leading/identification systems).

For this purpose, time-independent identification parameters/characteristic values 8 are formed/ascertained from a rollover signal 4 measured for a rail vehicle wheel 1 in ascertainment unit 51 of "MULTIRAIL WheelScan," which are combined 110 into a detection pattern 5 specific to this rail vehicle wheel 1, i.e. a digital fingerprint 5 for this rail vehicle wheel 1. This detection pattern 5 or this digital fingerprint permits a unique identification 100 of rail vehicle wheel 1 later on.

In this case, (a) the wheel circumference of the rail vehicle wheel, (b) a periodic out-of-roundness of the rail vehicle wheel, (c) the load pattern, i.e. vertical force/vertical contact force F, as a function of the wheel angle, and (d) the wavelength spectrum of the load pattern, i.e. vertical force/vertical contact force F, are used as time-independent identification parameters/characteristic values 8 formed from rollover signal 4 and combined into fingerprint 5.

In other words, (a) the wheel circumference of the rail vehicle wheel, (b) a periodic out-of-roundness of the rail vehicle wheel, (c) the load pattern, i.e. vertical force/vertical contact force F, as a function of the wheel angle, and (d) the wavelength spectrum of the load pattern, i.e. vertical force/vertical contact force F, are calculated from rollover signal 4 or vertical contact force F of a rail vehicle wheel 1 (to be identified).

Characteristic values 8 (*a*) through (*d*) are then compiled or combined into fingerprint 5 specific to rail vehicle wheel 1 to be identified.

If digital fingerprint 5 (which includes related rollover signal 4 measured by "MULTIRAIL WheelScan" as well as the evaluations associated with "MULTIRAIL WheelScan," including the wheel diagnosis (wheel imperfections, flat spots, roughnesses and out-of-roundnesses)) is thus ascertained 110 for a rail vehicle wheel 1, the latter is compared 120 with, for example (likewise formed) reference fingerprints 9 of already "known/recognized" or "detected" rail vehicle wheels stored in database 52, with the aid of ascertainment unit 51.

In other words, a multiplicity of reference fingerprints 9 are stored in database 52, together with the particular "MULTIRAIL WheelScan" evaluations (among other things, related, associated wheel diagnoses (wheel imperfections, flat spots, roughnesses and out-of-roundnesses).

If comparison 120 of currently ascertained fingerprint 5 and reference fingerprints 9 supply a "hit," i.e. if currently ascertained fingerprint 5 matches one of stored reference fingerprints 9, possibly taking into account tolerances, rail vehicle wheel 1 to be identified is thus identified 130.

The comparison between the "MULTIRAIL WheelScan" evaluations of currently ascertained fingerprint 5 with those of "hit fingerprint" 9 then provides information on a condition/damage development, for example the development of/change in the wheel imperfections, flat spots, roughnesses and out-of-roundnesses on this, now identified, rail vehicle wheel 1 (trend tracking/condition monitoring 170).

In parallel thereto, the database is updated 160, i.e. stored "hit fingerprint" 9 and its stored "MULTIRAIL WheelScan" evaluations are replaced by current fingerprint 5 of recognized or identified rail vehicle wheel 1 and its "MULTIRAIL WheelScan" evaluations of recognized or identified rail vehicle wheel 1.

FIG. 2 shows an example of time-independent identification parameter/characteristic value 8 (*c*), i.e. the load pattern, i.e. vertical force/vertical contact force F, as a function of the wheel angle, for one and the same rail vehicle wheel 1 at four different points in time.

In other words, one and the same rail vehicle wheel rolled over 7 "MULTIRAIL WheelScan" at four different points in time (FIGS. 2*a* through 2*d*) (and also once in the opposite rollover direction (FIG. 2*d*)), digital fingerprint 5 being determined each time, and thus also time-independent identification parameter/characteristic value 8 (*c*), i.e. the load pattern, i.e. vertical force/vertical contact force F, as a function of the wheel angle. (FIGS. 2*a* through 2*d*) The four load patterns were thus able to be recognized by means of identification 100 of rail vehicle wheel 1 and assigned to each other as belonging to this rail vehicle wheel 1.

As shown in FIGS. 2*a* through 2*d*, the four load patterns are essentially identical if one takes into account the reversed direction of rotation in FIG. 2*d*, which results in an opposite rollover direction by rollover 7.

Measuring sections 10 of this type, equipped with "MULTIRAIL WheelScan" (including computing system/computer 51 (ascertainment unit 51)), may also be arranged multiple times in the rail network—and thus measure (and analyze and identify) rollover signals 4 of rail vehicle wheels 1 multiple times at different points in the rail network during their rollover 7.

If the latter are networked with each other, a continuous matching with databases 52 taking place, trend tracking or condition monitoring 170 may also be expanded "locally" thereby.

Correspondingly to the recognition or identification 100 of a rail vehicle wheel 1, an identification of an axle 16 of rail vehicle 14, a bogie 15 of rail vehicle 14 and/or rail vehicle 14 may take place, in this case digital fingerprints 5 of multiple rail vehicle wheels 1 to be identified being then combined, i.e. those of an axle 16 of rail vehicle 14, a bogie 15 of rail vehicle 14 and/or rail vehicle 14.

For the recognition or the "identification comparison" with the one or multiple reference-specific fingerprints 9, corresponding combinations of the one or multiple reference-specific fingerprints 9 may also be formed in database 52.

The comparison 120 itself then takes place as usual between current fingerprint 5 and reference fingerprints 9.

Although the invention was illustrated and described in greater detail by the preferred exemplary embodiments, the invention is not limited by the disclosed examples, and other variations may be derived therefrom without departing from the scope of protection of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for recognizing a rail vehicle wheel, the method comprising:

detecting a rollover of rail vehicle wheels on a load measuring device arranged on a rail;

ascertaining a specific detection pattern using a rollover signal of one of the rail vehicle wheels, the specific detection pattern being ascertained via the load measuring device arranged on the rail, the rollover signal describing a time characteristic of a rail load induced by the one of the rail vehicle wheels on the rail equipped with the load-measuring device during the rollover, the ascertained specific detection pattern comprising one or multiple time-independent identification parameter(s)/characteristic value(s) ascertained using the rollover signal;

comparing the ascertained specific detection pattern of the one of the rail vehicle wheels with previously stored reference-specific detection patterns associated with the rail vehicle wheels; and recognizing, via the comparison, that the ascertained specific detection pattern of the one of the rail vehicle wheels rolling over the load measuring device corresponds to one of the previously stored reference-specific detection patterns, the one of the previously stored reference-specific detection patterns being associated with a specific rail vehicle wheel of the rail vehicle wheels, such that the one of the rail vehicle wheels rolling over the load measuring device is identified as the specific rail vehicle wheel.

2. The method according to claim 1, wherein the rollover signal is ascertained with the aid of the load-measuring device when the one of the rail vehicle wheels rolls over the rail equipped with the load-measuring device, wherein the load-measuring device is a measuring section that comprises a measuring rail or a measuring tie.

3. The method according to claim 1, wherein the rollover signal is a force, moment and/or acceleration signal.

4. The method according to claim 1, wherein the one or multiple time-independent identification parameter/characteristic value is:

a wheel circumference, an imperfection, a roughness or an out-of-roundness; and/or a load pattern as a function of a wheel angle or the wheel circumference; and/or a frequency spectrum, a wavelength spectrum or an amplitude ratio of the load pattern.

5. The method according to claim 1, wherein the ascertained specific detection pattern additionally comprises at least one further time-independent identification parameter/characteristic value ascertained using a further measuring signal.

6. The method according to claim 5, wherein the at least one further time-independent identification parameter/characteristic value is a rate of wear from a transverse profile of the one of the rail vehicle wheels.

7. The method according to claim 1, wherein the previously stored reference-specific detection are stored in a database and/or the previously stored reference-specific detection patterns are updated with the ascertained specific detection pattern of the one of the rail vehicle wheels to be identified in the database.

8. The method according to claim 1, wherein a deviation/tolerance is permitted or taken into account during the comparison.

9. The method according to claim 1, wherein, the method is for a trend tracking of a physical variable of the one of the rail vehicle wheels, wherein the ascertained specific detection pattern of the one of the rail vehicle wheels is ascertained and compared multiple times.

10. The method according to claim 9, wherein the method is for preventive maintenance, and wherein a wheel damage on the one of the rail vehicle wheels identified or to be identified is detected using the trend tracking and/or the multiple comparisons.

11. The method according to claim 1, wherein the method detects an axle of a rail vehicle, a bogie of the rail vehicle and/or the rail vehicle, the ascertained specific detection patterns of multiple rail vehicle wheels to be identified being combined.

12. The method according to claim 11, wherein a position of the one of the rail vehicle wheels to be identified in the rail vehicle is taken into account during the combination.

13. An arrangement for recognizing a rail vehicle wheel, the arrangement comprising:

an ascertainment unit configured to carry out the method according to claim 1.

14. The arrangement according to claim 13, further comprising the load measuring device which is configured to ascertain the rollover signal.

15. The arrangement according to claim 13, further comprising a database in which the previously stored reference-specific detection patterns are stored.

16. The method according to claim 4, wherein the imperfection includes a flat spot, the out-of-roundness includes a periodic out-of-roundness, and the load pattern is a phase-adjusted and/or standardized load pattern.

17. The method according to claim 6, wherein the at least one further time-independent identification parameter/characteristic value is a wheel flange thickness, a wheel flange height and/or a flank angle.

* * * * *